US007234621B2

(12) United States Patent
Marks

(10) Patent No.: US 7,234,621 B2
(45) **Date of Patent: *Jun. 26, 2007**

(54) STAPLER SAFETY DEVICE TO LIMIT MOTION OF STRIKER

(75) Inventor: Joel S. Marks, Sherman Oaks, CA (US)

(73) Assignee: Worktools, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/305,773

(22) Filed: Dec. 15, 2005

(65) Prior Publication Data

US 2006/0186170 A1 Aug. 24, 2006

Related U.S. Application Data

(63) Continuation-in-part of application No. 11/064,493, filed on Feb. 23, 2005, now Pat. No. 7,124,922.

(51) Int. Cl.
*B25C 1/04* (2006.01)

(52) U.S. Cl. ..... 227/8; 227/120; 227/129; 227/132

(58) Field of Classification Search ..... 227/120, 227/129, 132, 8, 108, 121, 125, 126
See application file for complete search history.

(56) References Cited

U.S. PATENT DOCUMENTS

| | | | |
|---|---|---|---|
| 1,956,174 | A | 4/1934 | Maynard |
| 2,142,782 | A | 1/1939 | Gillette |
| 2,218,794 | A | 10/1940 | Kilbride |
| 2,271,479 | A | 1/1942 | Gambao |
| 2,421,429 | A | 6/1947 | Obstfeld |
| 2,657,384 | A | 11/1953 | Boroughs |
| 2,726,391 | A | 12/1955 | Pilblad |
| 2,733,440 | A | 2/1956 | Jenny |
| 2,884,636 | A | 5/1959 | Abrams |
| D186,342 | S | 10/1959 | Marano |
| 2,915,753 | A | 12/1959 | Ruskin |
| 3,034,128 | A | 5/1962 | Robbins |

(Continued)

FOREIGN PATENT DOCUMENTS

| | | |
|---|---|---|
| DE | 28 56 621 | 7/1980 |

(Continued)

*Primary Examiner*—Brian Nash
(74) *Attorney, Agent, or Firm*—Paul Y. Feng; Fulwider Patent LLP

(57) ABSTRACT

A safety mechanism to prevent unintended ejection of a staple or fastener in a stapler or fastening tool. A low-start version of the stapler has a handle that when pressed pivots a lever which lifts a striker and energizes a power spring. At the release point, the striker is released and accelerated under spring bias into a staple, ejecting the staple by impact blow. A high-start version has the striker stationary in the upper position as the power spring is energized. In the safety mechanism, a movable hook or arm selectively prevents the striker, and linked components thereto, from completing an operational cycle. In one embodiment the safety mechanism includes a working surface sensing button bar operating in conjunction with the hook that latches the striker. The safety mechanism can also be a pivoting lock bar that engages the working surface, which surface pivots the lock bar into engaging the power spring, handle, and/or striker thereby preventing such components from reaching the release point.

24 Claims, 12 Drawing Sheets

U.S. PATENT DOCUMENTS

| | | | | | |
|---|---|---|---|---|---|
| 3,630,428 | A | | 12/1971 | Olney et al. | |
| 3,758,016 | A | | 9/1973 | Olney et al. | |
| 3,834,602 | A | * | 9/1974 | Obergfell | 227/120 |
| 3,905,535 | A | * | 9/1975 | Novak et al. | 227/120 |
| 3,948,426 | A | | 4/1976 | La Pointe | |
| D243,148 | S | | 1/1977 | Levin | |
| 4,156,499 | A | | 5/1979 | Frank | |
| 4,206,863 | A | | 6/1980 | Savino | |
| 4,367,833 | A | | 1/1983 | Kenney | |
| 4,463,890 | A | | 8/1984 | Ruskin | |
| 4,546,909 | A | | 10/1985 | Ebihara | |
| 4,598,852 | A | | 7/1986 | Olesen | |
| 4,666,075 | A | | 5/1987 | Olesen | |
| 4,795,073 | A | | 1/1989 | Yamamoto et al. | |
| 4,811,884 | A | | 3/1989 | Sato | |
| 5,004,142 | A | | 4/1991 | Olesen | |
| 5,356,063 | A | | 10/1994 | Perez | |
| 5,470,006 | A | * | 11/1995 | Rodak | 227/176.1 |
| 5,470,009 | A | * | 11/1995 | Rodak | 227/176.1 |
| 5,476,206 | A | * | 12/1995 | Green et al. | 227/176.1 |
| 5,699,949 | A | | 12/1997 | Marks | |
| 5,715,982 | A | | 2/1998 | Adachi | |
| 5,816,470 | A | | 10/1998 | Plato et al. | |
| 5,836,501 | A | * | 11/1998 | Lai | 227/8 |
| D413,239 | S | | 8/1999 | Lovegrove et al. | |
| 5,931,364 | A | | 8/1999 | Dennis | |
| 5,979,736 | A | | 11/1999 | Edeholt | |
| 5,988,478 | A | | 11/1999 | Marks | |
| 6,123,241 | A | * | 9/2000 | Walter et al. | 227/8 |
| 6,145,728 | A | | 11/2000 | Marks | |
| 6,152,347 | A | | 11/2000 | Wilson et al. | |
| D437,754 | S | | 2/2001 | Jacquet | |
| 6,918,525 | B2 | * | 7/2005 | Marks | 227/120 |
| 7,032,794 | B1 | * | 4/2006 | Hung et al. | 227/8 |
| 2004/0232192 | A1 | | 11/2004 | Marks | |

FOREIGN PATENT DOCUMENTS

| | | | |
|---|---|---|---|
| DE | 1971249 | A1 | 10/1998 |
| DE | 10138447 | A1 | 7/2003 |
| DE | 10225816 | A1 | 1/2004 |
| GB | 2 032 327 | A | 5/1980 |
| GB | 2 229 129 | A | 9/1990 |

* cited by examiner

STAPLER SAFETY DEVICE TO LIMIT MOTION OF STRIKER

CROSS-REFERENCE TO RELATED APPLICATIONS

This application is a continuation-in-part (CIP) of parent application Ser. No. 11/064,493, filed Feb. 23, 2005 now U.S. Pat. No. 7,124,922, by the same inventor, and whose entire contents are hereby incorporated by reference.

FIELD OF THE INVENTION

The present invention relates to spring-actuated staplers and similar self-powered tools for dispensing and driving fasteners. More precisely, the present invention relates to a safety mechanism for such staplers or tools.

BACKGROUND OF THE INVENTION

Staplers and related stapling devices eject staples out from a loading track into a work piece. Staplers are commonly known in two general forms or applications. A staple gun inserts a staple substantially unchanged into a work piece such as wood. A desktop stapler presses a staple against an anvil whereby the staple legs are bent behind sheets of paper. In either type of design, it is possible to eject a staple unintentionally toward a user by pointing the staple ejection port, for example, toward the face. Some staplers and most staple guns use energy stored in a spring to eject the staple. With spring-powered staplers being so common, such an injury to the user is possible.

Another type of stapler uses an electric, air, combustion, or other non-manual power source. Safety interlocks are well known in such powered applications. Typically a safety button near the staple ejection area must be pressed to enable a power circuit to be energized. In effect the trigger can switch the power device only when the tool is pressed against a work piece. U.S. Pat. No. 5,715,982 (Adachi) is an example of a protruding safety button used to lock out a trigger action in a power tool.

A similar type safety mechanism has not been effectively implemented in a manual stapler. This is likely because it is simple to disable a power circuit. For example, a microswitch may be linked to the safety button whereby the switch remains open until the button is pressed. This operation requires little force and allows for a relatively low strength plastic button assembly that is easily pressed inward to enable use. However, it is more complicated to disable a manually actuated device. In the case of a spring-actuated stapler the large impact forces make a disabling system especially difficult. One reason is that the stored potential energy of the spring is difficult to de-energize or redirect without using complicated or bulky latches, blocks, stops, etc. Also, a catch or safety that blocks the spring action must be rather bulky to absorb the high impact energy from the spring.

Moreover, a staple or other fastener may be ejected from a fastening device under different conditions. If a work piece is present, the energy of the staple is absorbed as the staple penetrates or bends about the material. If no work piece is present the staple is "dry fired." Most of the energy of the moving striker is dissipated by an internal absorber inside the conventional stapler. With a lightweight work piece the stapling energy is absorbed partly by the work piece and partly by the absorber.

The case of a dry fire is a concern of the present invention, where there is no work piece to stop the staple. Although most of the stapling energy is dissipated in the absorber, the staple will continue to shoot out under its own momentum.

There are several approaches to disable a manual stapler. For example, an actuating handle may be de-linked from the staple-ejecting striker by a safety device. Then pressing the handle will cause the handle to move but the striker remains still. Only the force from a return spring will be apparent upon the handle. Another approach to disabling a manual stapler entails immobilizing the handle. A strong safety mechanism is desirable to overcome the intentional, applied force from a user's hand. These and other issues are addressed by the present invention.

In a manual stapler, two striker rest positions may be used. A low-start stapler has a striker rest position in front of the staple track. The striker is raised against the bias of a power spring to a release position. The striker and spring are released to rapidly return to the lower rest position as a staple is ejected. A high-start stapler has a striker rest position above the staple track. The striker is stationary as the spring is energized or charged to a release point. The striker and spring are released to rapidly move to the lower position as a staple is ejected. The striker and spring then return to the upper rest position under bias of a reset spring. Conventional, non-spring powered desktop staplers are normally of the high-start type.

SUMMARY OF THE INVENTION

One approach to disable a manual stapler is to interfere with the movement of the power spring/striker combination. Specifically, the safety mechanism can limit the upward movement of the power spring/striker to keep it from reaching the release point, or the safety mechanism can obstruct the downward movement of the power spring/striker after release thus preventing the ejection of a staple.

Accordingly, the present invention is directed to a safety mechanism for spring-actuated staplers or similar self-powered tools used for dispensing and driving fasteners. In one embodiment, the present invention fastening device is a spring-actuated stapler that includes a track pivotably or slidably attached to a housing to guide staples upon the track toward a striker at the front of the stapler. The striker has a raised position above the staples and is held there against spring bias. Once released, the striker is accelerated under spring power to a lowered position in front of the staples at which moment the striker ejects the front-most staple out of the stapler by impact blow.

In a common design for a spring-actuated stapler, a striker has a rest position in front of a staple track. Pressing a handle causes the striker to rise in the stapler toward a release point where spring bias accelerates the striker toward and into the staple to eject the staple out from the stapler. In the present invention, a locking device prevents the striker from being released suddenly unless the stapler is pressed against a working surface. In various embodiments, the safety device substantially immobilizes the striker, limits the upward motion of the striker/power spring assembly to a position below that release point, limits the movement of the handle preventing release of the striker/power spring assembly, and/or limits the downward movement of the striker/power spring assembly after the release point is reached. Accordingly, the striker cannot be inadvertently released and the stapler accidentally fired at full force.

In various exemplary embodiments, an element of the safety device extends out from the bottom of the stapler.

Upon pressing a working surface, the element contacts the immovable surface and is pressed into the body of the stapler. A further part of the safety device moves out of the way of the striker, power spring, handle, and/or other moving element of the stapler to allow the striker to rise to the release point. When the striker or handle reaches its release point, the striker is released and freely accelerates into a staple for ejection.

DETAILED DESCRIPTION OF THE PREFERRED EMBODIMENTS

The present invention in various exemplary embodiments is directed to a safety mechanism useful in spring-actuated, spring energized, or similar self-powered type tools used in dispensing and driving fasteners. Examples include manual staplers, air powered industrial staplers, spring-actuated desktop staplers, spring powered staple guns, nail guns, and the like. The present invention safety mechanisms are intended to prevent a staple or like fastener from unintentionally or accidentally being ejected out of the stapling tool.

Figure 1:
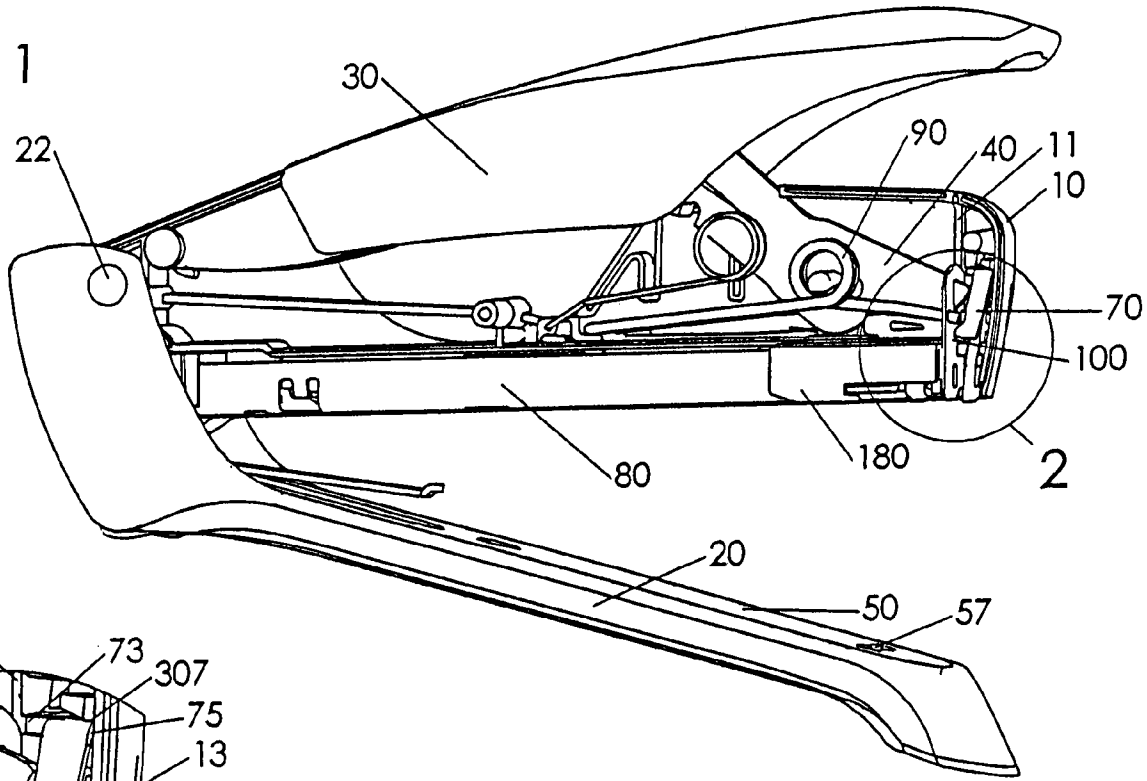
FIG. 1 is a side elevational view of a stapler incorporating one embodiment of the present invention, shown with half of the housing removed, the base partly open, and the striker in a lower most position before a safety device engages.

FIG. 1 is a side elevational view of a low-start type spring powered stapler with half of the housing removed to expose the interior components. In a preferred embodiment of the present invention, the spring powered stapler incorporates a safety mechanism that presents an obstruction to the internal moving components thus preventing a staple from being inadvertently ejected.

Figure 2:
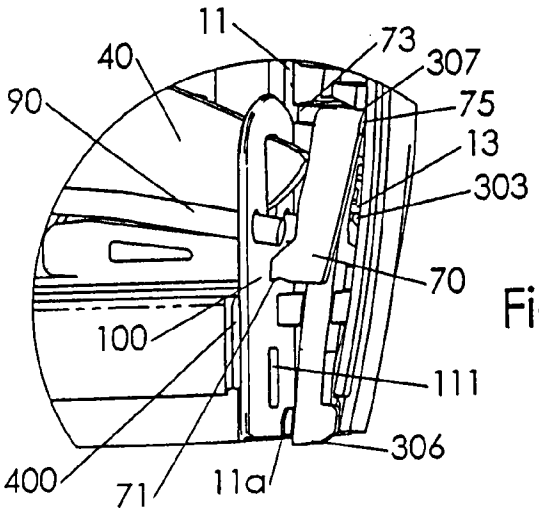
FIG. 2 is a magnified, detail view of the lower position striker of FIG. 1.
Figure 3:
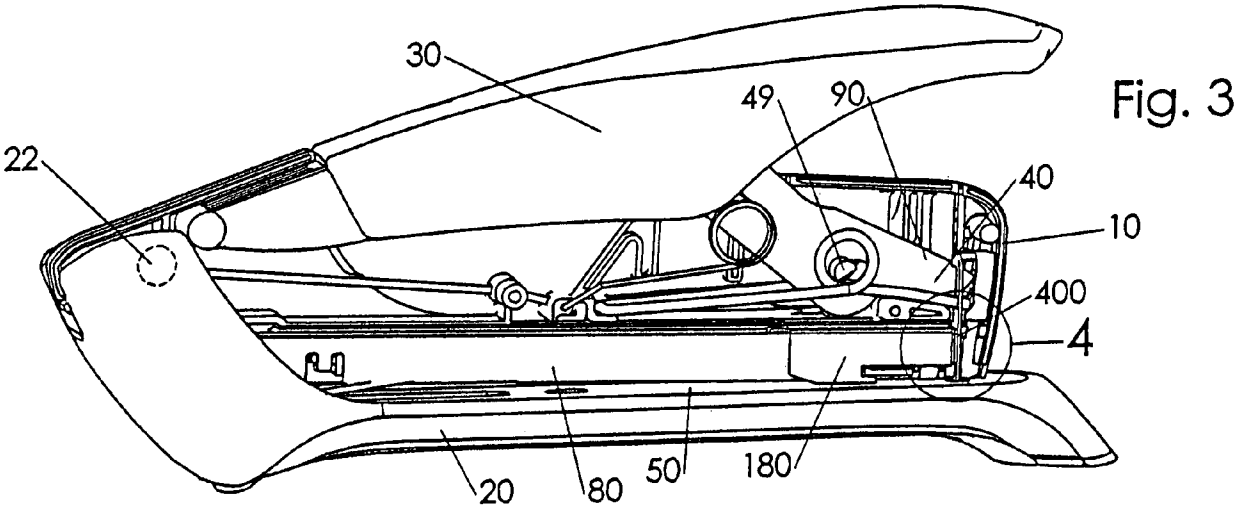
FIG. 3 is a side elevational view of the stapler according to FIG. 1, shown with half of the housing removed, the stapler pressed against the base, and the safety mechanism disengaged.

Striker 100 reciprocates vertically within striker slot 11, traversing between a striker "raised position" above staples 400 (FIG. 9) and front-most staple 401 (FIG. 4), and a striker "lowered position" immediately in front of front-most staple 401 (FIGS. 1–3). In FIG. 1, handle 30 is pivotably attached to housing 10 at a rear of housing 10.

A user pressing down on handle 30 causes lever 40 to rotate (counterclockwise in FIG. 1) within housing 10. Lever 10 pivots at hinge 49 (FIG. 3), and at its back end slidably engages handle 30 and at its forward end is temporarily linked to striker 100 (FIG. 2). Consequently, in the downward energizing stroke of handle 30, lever 40 rises at the front to lift striker 100 upward. When the front of lever 40 rises, striker 100 is lifted upward in striker slot 11, starting in the striker lowered position shown in FIGS. 1–3 and moving toward the striker raised position. As seen in FIG. 2, a power spring 90 is connected to striker 100, so as lever 40 lifts the striker upward, the lever 40 simultaneously works against spring bias and energizes power spring 90.

At the release point, lever 40 de-links or disengages from and releases striker 100. Without the lever 40 to oppose the stored potential energy, power spring 90 is now free to accelerate striker 100 downward toward front staple 401 to eject it forcefully out of the stapler by an impact blow. A reset spring (not shown) may be used to return the internal components to their respective start positions. Staples 400 are held in a chamber and guided upon track 80 toward striker 100 by urging from a spring-biased pusher 180. Further details of the structure and operation of a spring powered stapler may be found in, for example, U.S. Pat. No. 6,918,525 (Marks), titled "Spring Energized Desktop Stapler," whose entire contents are hereby incorporated by reference.

It may be desired to use the stapler as a tacker to drive a staple into wood or similar material. Or it may be required to open base 20 to load staples onto track 80. In both instances then, base 20 is opened away from housing 10 as shown in FIG. 1. To do this, base 20 pivots about hinge post 22. If a user accidentally presses handle 30 while staples 400 are loaded and base 20 is opened, a staple may be ejected out of the stapler toward the user or another unintended direction.

Figure 7:
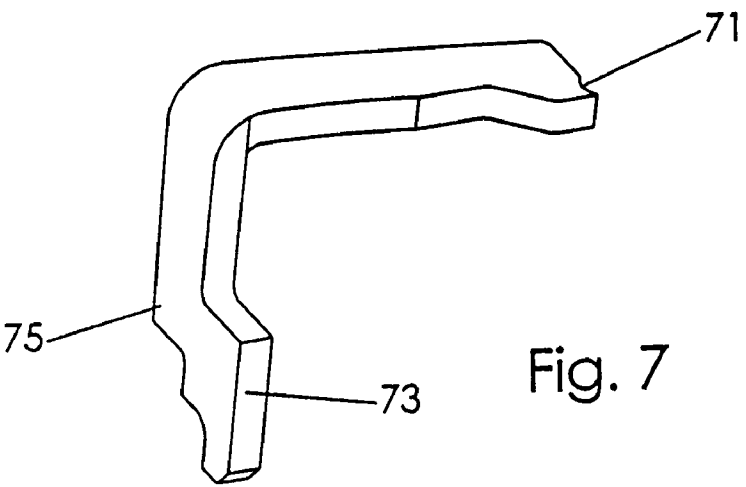
FIG. 7 is a perspective view of a safety hook.

To avoid the foregoing circumstances, according to one exemplary embodiment of the present invention, safety hook 70 is normally biased toward striker slot 11 at hook end 71, as seen in FIGS. 1 and 2. Hook end 71 gently presses striker 100 in these views. As best seen in FIG. 7, hook 70 preferably has an L shape with a small hook at one end 71 and a large surface area pivot end 73 extending from a flat pivot edge 75. When assembled inside the stapler, shown in FIGS. 1–5, hook end 71 is preferably oriented so that it faces downward within the stapler. Hook 70 is lightly biased against striker 100 in FIGS. 1 and 2. As striker 100 moves upward to the position of FIG. 9, hook end 71 enters opening 111 of striker 100. Hook 70 then forms a latch or detent to prevent further raising of striker 100.

The safety mechanism that is used to selectively obstruct striker slot 11 described above needs to be activated and deactivated. To accomplish this, the present invention provides a sensor or detector. Specifically, a sensor or button bar 300, pin, rod, feeler, or the like engages working surface 120, and this engagement deactivates the safety hook 70 (FIG. 5) by moving the hook away from striker 100.

Striker slot 11 should be unobstructed when the stapler is pressed against a working surface and prepared to fire. The working surface may be, for example, cover plate 50 of base 20 if a stack of papers is being fastened. Or the working surface may be a bulletin board or wooden stud in a tacking job.

Figure 4:
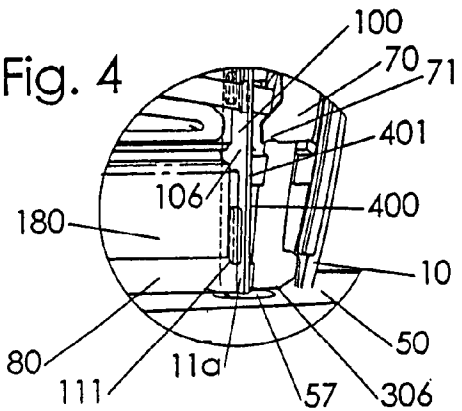
FIG. 4 is a magnified, detail view of the disengaged safety mechanism of FIG. 3.

Generally, the sensor is pushed into the stapler, or equivalently into housing 10, by the working surface. It is desirable that the sensor be as close as possible to the staple exit location so that the sensor operates precisely at the location that is being stapled. This is important if an irregular surface is being stapled and the working surface includes a depression or recess near the staple exit area 11*a* (FIG. 4). A rising striker under normal operation could be unintentionally blocked by hook 70 if the sensor extends into the depression even as the staple is aimed at a raised part of the working surface adjacent to the depression. On the other hand, the sensor should not be located precisely at the staple slot exit 11*a* so that the sensor does not enter the depression formed by anvil 57, shown in FIG. 4. The depression in anvil 57 is there, of course, to bend the staple legs behind a stack of the stack of papers to be bound together.

Figure 5:
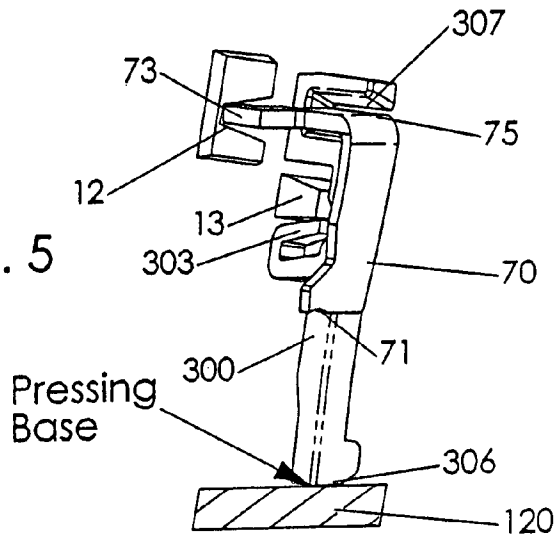
FIG. 5 is a magnified, perspective view of the safety elements of one embodiment of the present invention, with the button bar of the stapler pressing a base or other working surface to disengage the safety mechanism as shown in FIGS. 3 and 4.

To apply the foregoing concept, the exemplary embodiment of the safety mechanism preferably employs hooking bar 70 and button bar 300, shown together in FIG. 5. Button bar 300 is a shaped, preferably plastic, bar that serves as the sensor and converts vertical motion into rotational motion of hook 70. The hook 70 is preferably made from hardened steel to endure the forces involved with latching the striker.

Figure 8:
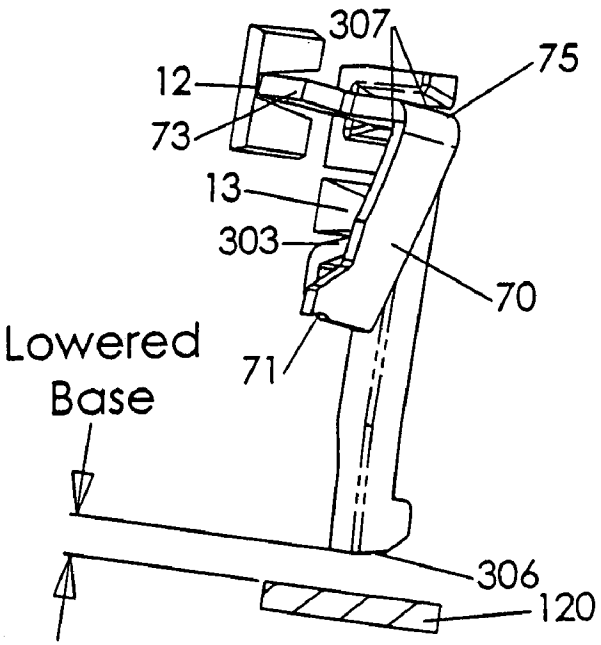
FIG. 8 is a perspective view of the safety elements of FIG. 5, with the stapler spaced away from a working surface and the safety mechanism engaged.
Figure 6:
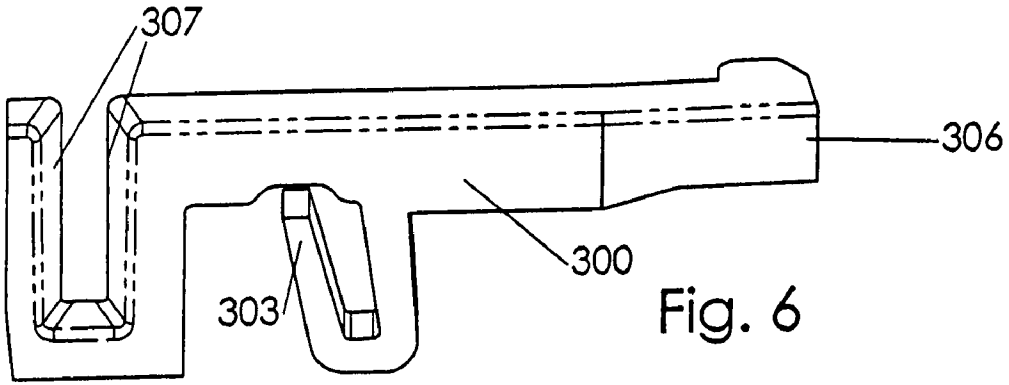
FIG. 6 is a front, side perspective view of a safety button bar.

As best seen in FIGS. 6 and 7, button bar 300 has an elongated bar shape with two curled, hook-like portions. More precisely, button bar 300 includes sensing end 306, hook engaging slot 307, and bias spring 303. Biasing spring 303 when formed from a semi-rigid plastic or resilient metal has a cantilever arm that has compliance thus creating the spring bias action. As seen in FIG. 8, biasing spring 303 urges button bar 300 downward in the drawing, out of housing 10 toward working surface 120. It is possible to use a rubber pad or other resilient material mounted to immobile housing rib 13 in place of the cantilever arm to achieve this compliance. To save cost, button bar 300 may be made from a plastic material since it does not directly interact with the high impact components. Rather, button bar 300 controls the position of hook 70.

In FIGS. 5 and 8, the interaction between button bar 300 and hook 70 is shown. Sensing end 306 extends out slightly from the bottom of the stapler. In FIG. 5, button sensing end 306 presses against working surface (i.e., "pressing base") 120. Since working surface 120 is typically relatively rigid and immovable, button bar 300 is itself forced upward toward or into housing 10. Similarly, in FIG. 3, button sensing end 306 is depicted pressing against a working surface which in this instance is cover plate 50.

Hook pivot end 73 fits into immobile notch 12 formed into the interior of housing 10, as seen in FIG. 5. Flat pivot edge 75 is preferably an enlarged flat area of the hook 70 that is captured with slight play within slot 307 of button bar 300. Slot 307 preferably has a tapered open area so that captured pivot edge 75 can flap freely up and down therein. Hook 70 is thus linked to button bar 300.

As button bar 300 is forced upward by contact with working surface 120, slot 307 moves up and forces captured pivot edge 75 up with it. The very tip of hook pivot end 73 is captured within immobile notch 12 inside housing 10, and preferably adjacent to striker slot 11. In FIG. 2, this close spacing of hook pivot end 73 and striker slot 11 is visible. By preferably positioning pivoting end 73 as near as possible to striker 100, the assembly of hook 70 and button bar 300 does not extend farther forward than necessary. The assembly therefore fits advantageously into a compact front end of the stapler.

In FIG. 8, a narrow rib of notch 12 defines a left or rear position limit of the upper part of hook 70. Notch 12 also has an optional tapered open area to accommodate the pivoting or flapping movement of hook pivot end 73 therein. In this manner, hook pivot end 73 does not contact striker 100 as the striker moves vertically within slot 11. As seen in FIG. 5, as button bar 300 is pushed upward, hook 70 pivots counterclockwise about notch 12, and hook end 71 moves toward the front of the stapler (to the right in FIG. 5); also, as hook 70 rotates counterclockwise, hook edge 75 moves upward.

In FIG. 8, working surface 120 is spaced away from button sensing end 306, which occurs when base 20 is pivoted to a lowered position. As described above, sensing end 306 is biased vertically downward as a result of bias spring 303 pressing against rib 13 of housing 10. Therefore, button bar 300 is normally in the lowered position of FIG. 8, and hook end 71 is pointing rearward and biased toward the striker position (to the left in FIG. 8). Hook end 71 thus is prepared to engage opening 111 and substantially immobilize striker 100 as the striker rises so that the handle cannot move to the lower most position and no staples can be ejected by impact blow from the striker.

In the exemplary embodiments, the elements of the safety mechanism are entirely contained in the small, compact space in the front of striker 100. Hook 70 and button bar 300 are preferably narrow structures elongated in a substantially parallel relationship to striker 100.

In FIGS. 1–2, hook 70 is in an intermediate position pressing gently rearward against striker 100 as a result of a bias from spring arm 303 of button bar 300 according to the above described linkages. FIG. 5 provides a simplified view of the hook 70 and button bar 300 assembly, showing spring arm 303 pressing against housing rib 13. Button bar 300 is similarly in an intermediate position; its link to hook 70 prevents the button bar from fully extending under the bias of spring arm 303.

In FIGS. 3–5, button bar 300 is retracted by pressing on working surface 120. Hook end 71 is moved forward away from striker 100 as seen in FIG. 4 thus releasing the striker. FIG. 8 shows hook 70 in the engaged position where hook end 71 is moved rearward.

Figures 9, 10:
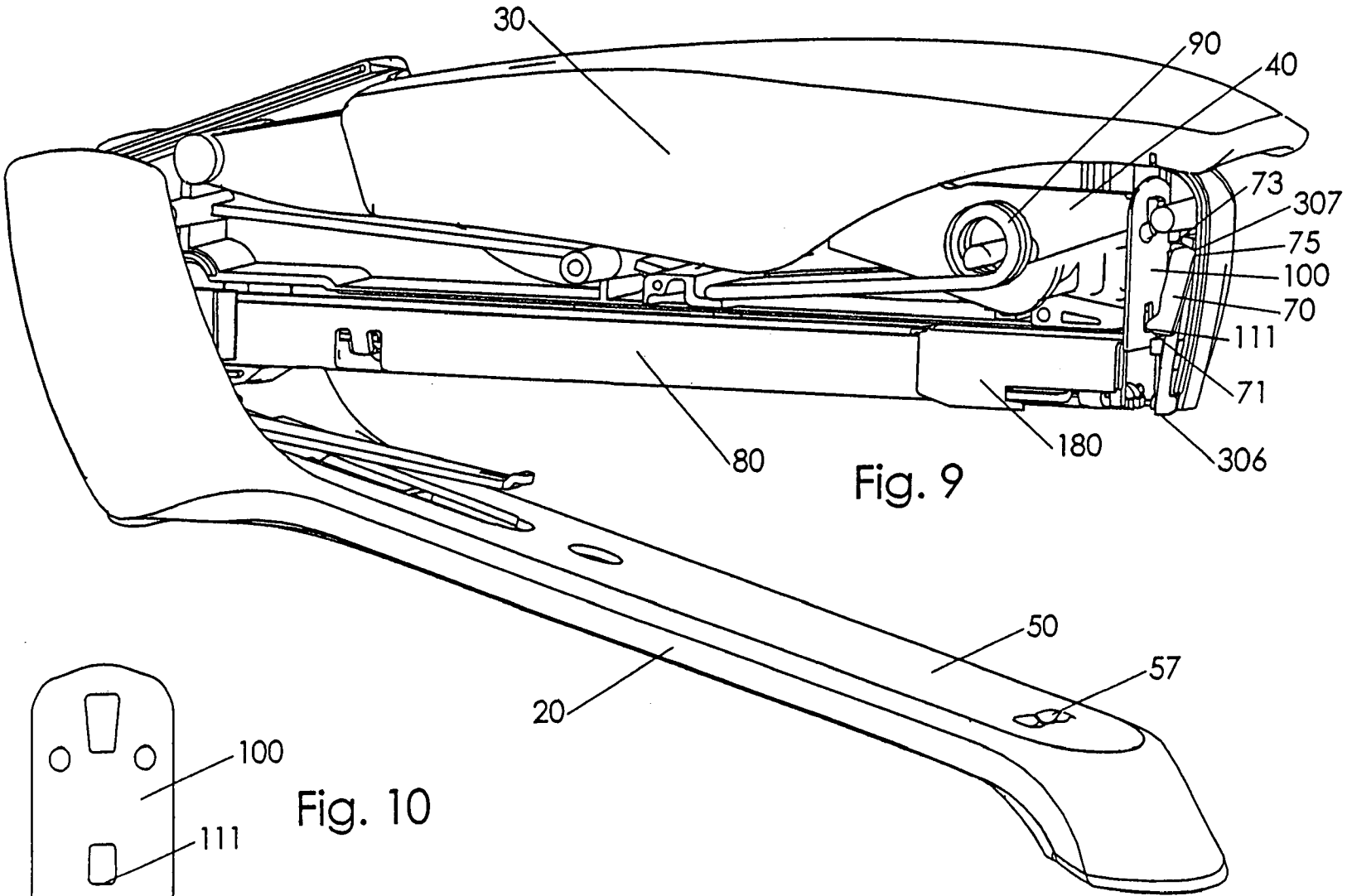
FIG. 9 is a side elevational view of the stapler of FIGS. 1 and 3, shown with half of the housing removed, the base partly open, and the striker raised to press the engaged safety hook.
FIG. 10 is a front elevational view of a striker having an opening for receiving the hook(s) of a safety mechanism.

FIG. 9 is a side elevational view of the stapler with half of the housing removed and base 20 swung partly away from housing 10. FIG. 9 further shows the internal components in the position of FIG. 8 with the hook end 71 extending into one or more openings 111 of striker 100. As striker 100 moves upward from the rest position of FIGS. 1 and 2, the striker slides against hook 70 until opening 111 moves into alignment with hook end 71. Hook end 71 is urged indirectly by the bias of spring arm 303 to move into opening 111 whereby the hook presses a lower edge of opening 111. At this moment, striker 100 is latched by hook end 71 and cannot move farther upward despite further pressure applied by the user on handle 30.

Striker 100 is normally stopped while it is still partly in front of staple track 80 as seen in FIG. 9. Then staples 400 cannot advance to a position underneath striker 100 despite being biased in that direction by spring powered pusher 180. As long as striker 100 is stopped before its release point that would otherwise de-link it from lever 40, the striker will be lowered slowly as handle 30 is raised. Therefore, even if a staple advances under striker 100, the staple will exit the stapler slowly with low inertia rather than be ejected suddenly after the release point.

In an alternative embodiment (not shown), hook 70 is made to be longer so that hook end 71 is placed at a lower position relative to the height of housing 10. Hook end 71 then engages opening 111 of striker 100 closer to the start of the upward motion of the striker.

An advantage of the later engagement, as shown in FIGS. 1–2, is a more natural feel for a user. The handle moves through most of its normal stroke against the bias of the power spring. Although the release of the striker does not occur, the mechanism does not feel "stuck" to the user, which might otherwise mislead the user into believing that the stapler had jammed or malfunctioned. On the other hand, if the handle cannot move at all from an early action of hook 70 immobilizing the striker/power spring assembly, a user might be inclined to force the handle to move, thereby possibly breaking the mechanism. This concept of late engagement can apply also to the other embodiments disclosed herein.

In an alternative embodiment (not shown), the button bar may be a straight pin that engages the working surface at its bottom end and a hooking bar at the top end. The L-shaped hooking bar has a flat hooking edge area with a hooking portion on one side of where the button bar engages the hooking edge and a pivot point at the other side, as shown in FIG. 5. The pivot point in FIG. 5, namely, the interface of notch 12 and hook pivot end 73, can be replaced by using a pin to attach the hook pivot end to the housing. The pin serves as a hinge or pivot point. Thus, the vertical translation of the button bar into the hooking bar causes a rotational motion of the hooking bar to rotate the hooking bar about the pivot point. A rubber pad mounted against the housing interior pushing downward on the top of hooking bar biases the button bar to its normal position extending out of the housing, and would likewise rotate the hooking bar clockwise in FIG. 6 to the normal, blocked striker position.

Alternatively, the above-described safety mechanism may be fitted to the rear of striker 100. In this embodiment (not shown), a hook or equivalent extension may slide horizontally within track 80 including a rear, disengaged position away from striker slot 11 and a forward position wherein the front of the hook obstructs striker slot 11. A button bar or other sensing element is linked to the horizontally movable hook so that pressing the sensing element causes the hook to move toward its rear position.

Described below are more alternative embodiments to the present invention safety mechanism used to limit movement of the power spring/striker assembly. The drawings for these embodiments have been simplified for the sake of clarity.

Figure 11:
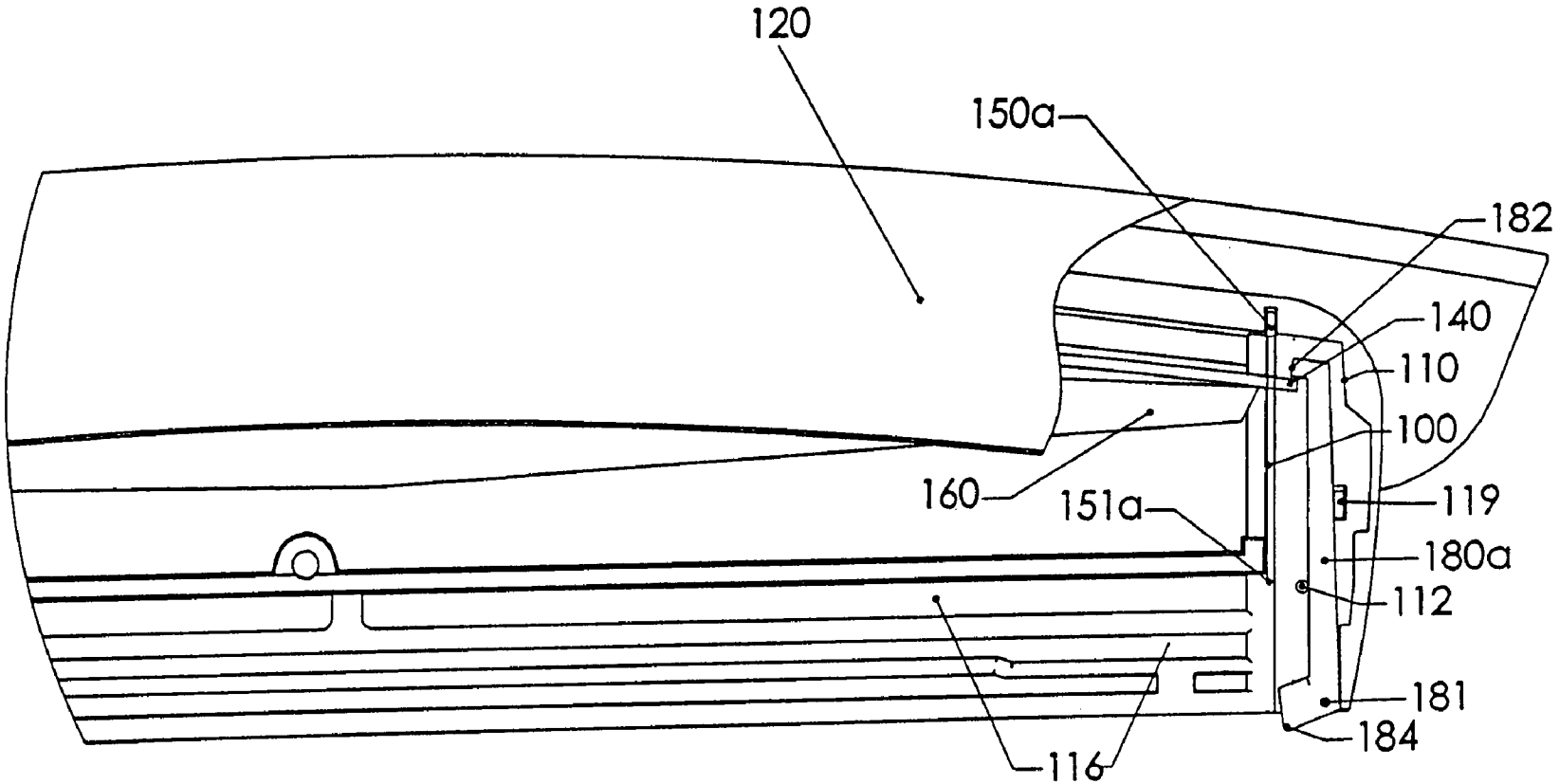
FIG. 11 is a simplified schematic view of a stapler having an alternative embodiment striker locking mechanism, wherein a pivoting lock bar limits the upward charging movement of the power spring from reaching its release position.
Figure 12:
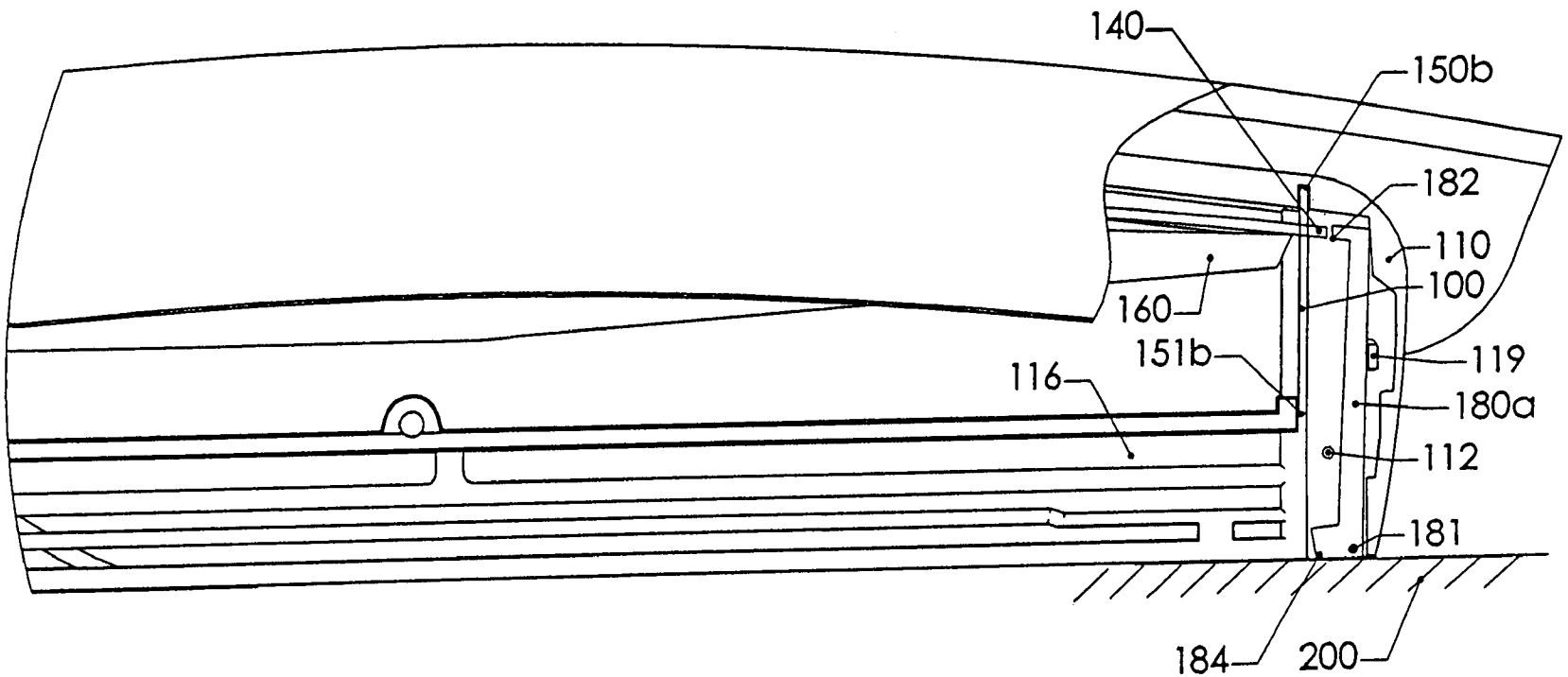
FIG. 12 is a simplified schematic view of the stapler of FIG. 11 wherein the striker locking mechanism is disengaged by pressing against a working surface.
Figure 13:
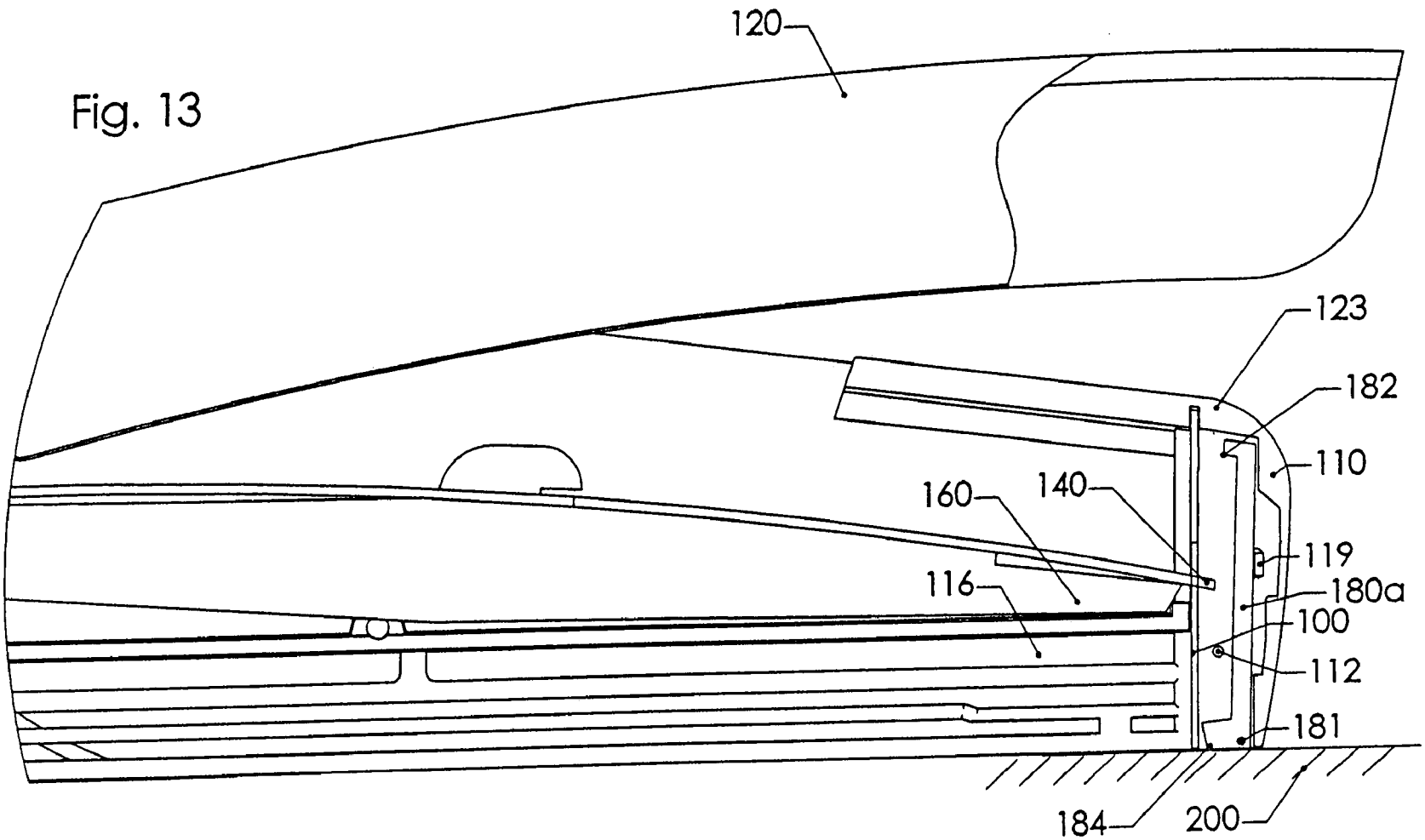
FIG. 13 is a simplified schematic view of the stapler of FIG. 11 with the locking mechanism shown disengaged while striker is in the lower position.

FIGS. 11–13 disclose in simplified schematic views an alternative embodiment of the present invention safety mechanism that uses a bottom pivoting lock bar 180*a* in a low-start type stapler. Optionally, the mechanism of FIGS. 11–13 could be used to limit the upward reset action in a high-start type stapler. A rest position of the stapler is shown in FIG. 13, wherein the stapler is abutting working surface 200. In FIG. 13, striker 100, power spring 140, and lever 160 are in a low position, where striker 100 is in front of staple track 116. Power spring 140 stores potential energy as handle 120 is pressed toward body 110. As in the above-described embodiments, when the spring and striker are released at a predetermined position of handle 120 and/or lever 160, the stored energy is transmitted to striker 100 which is rapidly accelerated into a staple (not shown). The impact forces the staple out from track 116 and drives it into an object or a stack of papers with great force.

Handle 120 is preferably linked to lever 160, for example, from behind a pivot location of lever 160 in body 110 (not shown) so that pressing handle 120 downward forces lever 160 to rotate within body 110 (counterclockwise in FIG. 13) and lift striker 100 upward toward the positions of FIGS. 11–12. An optional reset spring (not shown) urges lever 160 back toward the rest position of FIG. 13.

In the simplified schematic views of FIGS. 11–12, lock bar 180*a* is pivotably attached to stapler body 110 at pivot 181. Lock bar 180*a* is preferably made from an elongated, flat bar with hooked ends facing the same direction, namely, actuating tip 184 and engaging end 182. In FIG. 11, the stapler is not abutting a working surface and the present invention safety mechanism has engaged as power spring 160 is energized.

In FIG. 11, the stapler is in a partly actuated position. Lever 160 has forced power spring 140 and striker 100 toward, but not entirely to, a release point for striker 100. The stapler is not pressed against any object or working surface in FIG. 11. Therefore, actuating tip 184 of lock bar 180*a* is biased downward and extends out from the stapler body. Lock bar 180*a* normally rests against stop 112. Engaging end 182 of lock bar 180*a* is positioned above the front end or tip of power spring 140. The assembly of lever 160, power spring 140, and striker 100 cannot move farther upward at this moment, and space 150*a* remains above striker 100. In FIG. 11, the striker 100 is thus prevented from reaching its release point.

Lower end 151*a* of striker 100 preferably extends into staple track 116 in the partly actuated position to prevent staples from being urged forward by a spring in track 116. If handle 120 were slowly released, lever 160 would rotate clockwise (in FIG. 11) and striker 100 would then move slowly downward without ejecting a staple. Alternatively, even if a staple advances under striker 100, safety is still improved since striker 100 never travels up to the release point where it would otherwise be accelerated under spring power to eject a staple with great force. Instead, a staple is slowly urged out from track 116 of the stapler at a very low speed with minimal inertia for causing injury.

In various alternative embodiments (not shown), hooked engaging end 182 of lock bar 180*a* may extend over or through striker 100 instead of power spring 140, or engaging end 182 of lock bar 180*a* may extend over or through lever 160. In either instance, engaging end 182 limits upward translation of striker 100 preventing it from reaching its release point.

In FIG. 12, the stapler is shown pressed against working surface 200. In the case of a desktop stapler, working surface 200 may be a stack of paper to be fastened together. As a result of encountering rigid working surface 200, actuating tip 184 is pressed upward into body 110. The upward force causes lock bar 180*a* to rotate clockwise about pivot 181. Lock bar 180*a* simultaneously tips forward against the bias of elongated spring 119. Elongated spring 119 may be an extended, resilient element of body 110, if for example body 110 is constructed of a plastic material. Alternatively, elongated spring 119 may be a discrete piece of rubber, felt, cork, bead of cement, or like compliant material, or a coiled, cantilevered, or leaf spring.

An optional stop 112 is provided to limit how far back lock bar 180*a* may be pushed by elongated spring 119. That is, the bias of elongated spring 119 urges lock bar 180*a* to rotate counterclockwise into stop 112 as depicted in FIG. 11. Stop 112 may be a simple, molded extension of body 110, or it could be a pin or like immobile structure bonded, screwed, friction fitted, or similarly joined to the interior of the body. Alternatively, a front end of power spring 140 may provide the stop limit.

Back in FIG. 12, engaging end 182 has shifted forward and clear of the forward tip of power spring 40. The assembly of striker 100 and power spring 140 are thus free to move to the upper limit of motion of striker 100. Space 150*b* above striker 100 corresponds to the release point of the striker and is less than space 150*a* of FIG. 11. Striker 100, or more precisely, its lower end 151*b* has been raised high enough to clear staple track 116, so a staple may be urged by the power of a pusher spring (not shown) to a position underneath striker 100. Striker 100 after reaching its release point is freely accelerated downward by power spring 140 into the staple underneath. The resulting impact blow ejects the staple with great inertia and drives it into working surface 200.

Figure 14:
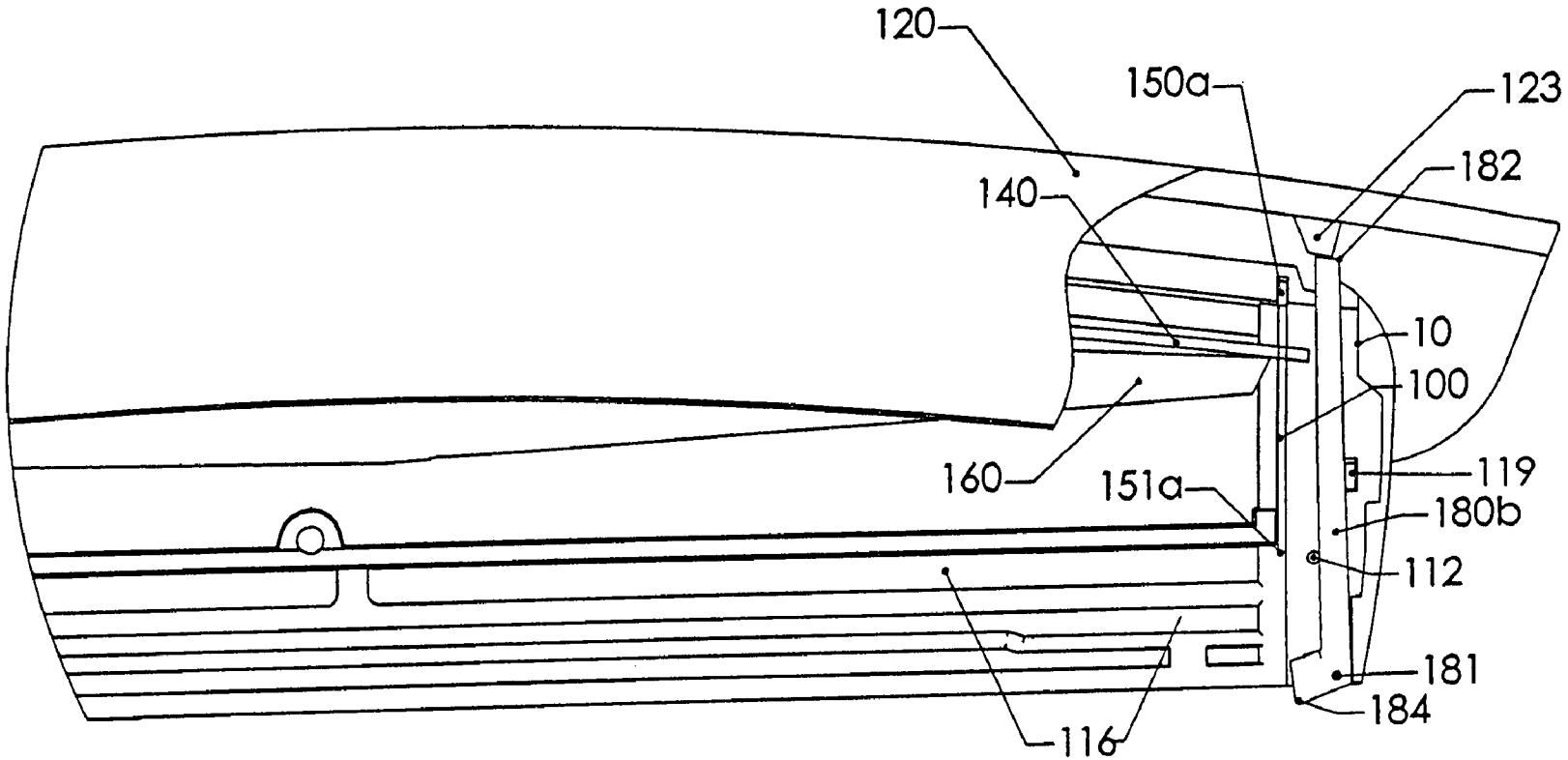
FIG. 14 is a simplified schematic view of a stapler having another alternative embodiment safety mechanism, which limits the downward movement of the handle from reaching its release position where the striker would otherwise be released.
Figure 15:
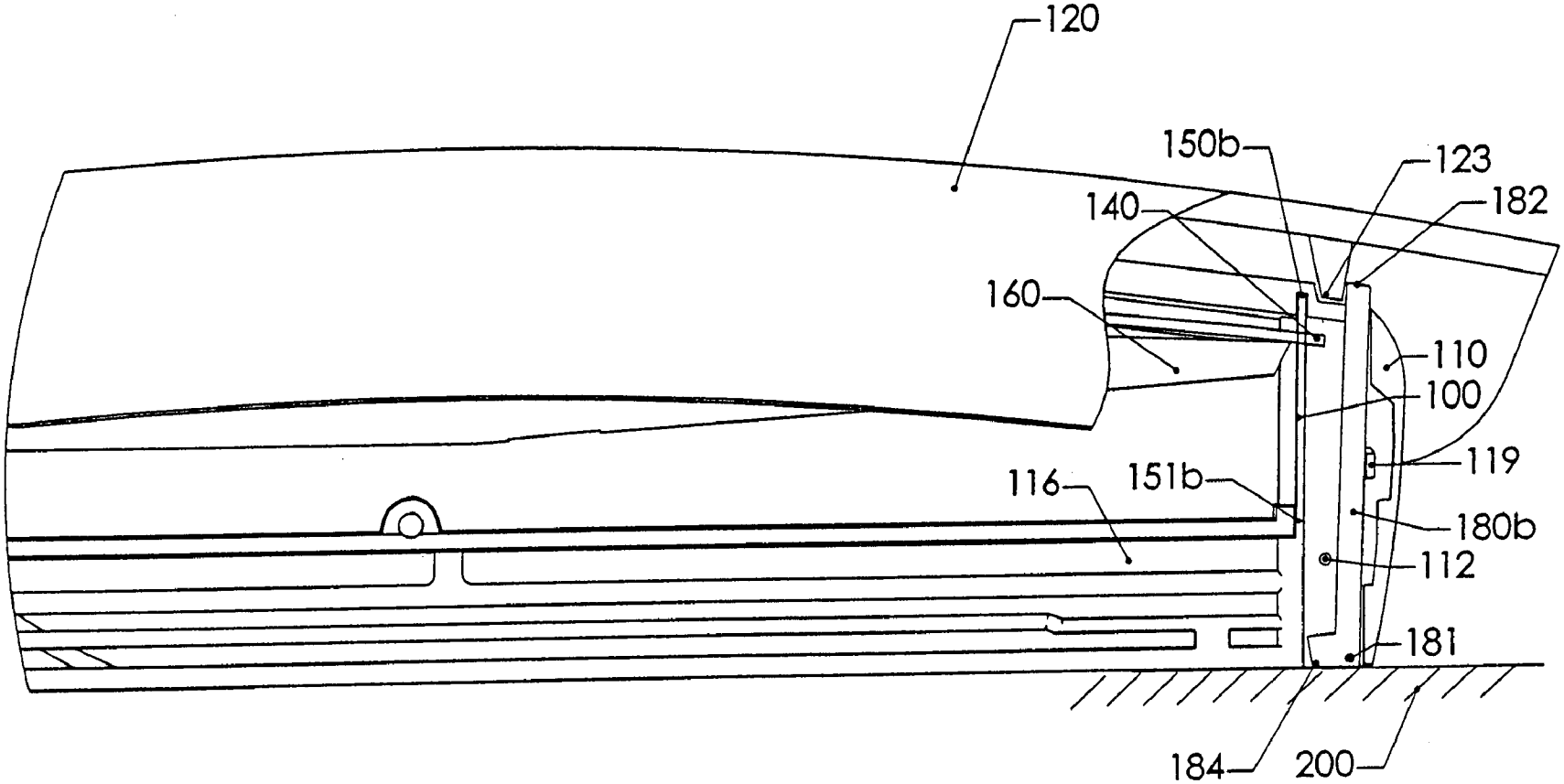
FIG. 15 is a simplified schematic view of the stapler of FIG. 14 wherein the safety mechanism is disengaged by pressing against a working surface.

FIGS. 14–15 show another alternative embodiment of the present invention somewhat related to the previous embodiments. In this embodiment, the safety mechanism again employs a pivoting lock bar 180*b*. Specifically, lock bar 180*b* blocks the downward motion of actuation handle 120 thus limiting the linked movement of power spring 140, lever 160 and/or striker 100; striker 100 cannot reach its release point and the stapler cannot fire a staple under full power.

In this embodiment, lock bar 180*b* is preferably shaped like a hockey stick or equivalent functional shape with a straight engaging end 182 and a hooked actuating tip 184. In FIG. 14, when the safety mechanism is actuated with actuating tip 184 protruding from under the stapler, engaging end 182 is positioned under extension 123 of handle 120 and blocks its downward motion. Handle 120 cannot move below its position shown in FIG. 14. Space 150*a* above striker 100 indicates that striker 100 is below the release point.

Striker lower end 151*a* preferably extends into track 116 so that a staple cannot be advanced under striker 100. If handle 120 is released, lever 160 rotates clockwise and striker 100 moves slowly downward. As discussed above, in the event that a staple is under striker 100 during this process, the staple is pushed out of the stapler slowly and safely.

In FIG. 15, actuating end 184 is pressed upon working surface 200. As a result of engaging working surface 200, actuating end 184 is pushed upward into the stapler body 110. Simultaneously, lock bar 180*b* is rotated clockwise so that its engaging end 182 moves clear of extension 123 of handle 120. Thus, handle 120 is now free to continue its downward movement ultimately arriving at a lowest position toward body 110 shown in FIG. 15. At this instant, space 150*b* is at its minimum, striker lower end 151*b* is located above track 116, and striker 100 is at the release point. A staple is advanced by spring bias to a position under striker 100. When striker 100 is released, it is accelerated into the staple underneath, ejecting the staple from the stapler and driving it forcefully into working surface 200.

In a modification of this embodiment, the raised extension 123 of handle 120 can be replaced with an adjacent recess, which recess would receive the engaging end 182 of lock bar 180*b* to enable the continued downward motion of the handle to fire the stapler. Therefore, either a projection such as raised extension 123 or a recess formed into the area underneath handle 120 could work in conjunction with engaging end 182 of lock bar 180*b* to engage or disengage the safety mechanism.

As in other embodiments, an optional elongated spring 119 urges lock bar 180*b* into its handle blocking position, while optional stop 112 limits how far elongated spring 119 can push lock bar 180*b*.

The discussion of FIGS. 14–15 relates to a low-start stapler. However, the safety mechanism using lock bar 180*b* may be effectively applied to a high-start stapler wherein the handle is prevented from lowering to a release point of the high-start mechanism.

Figure 16:
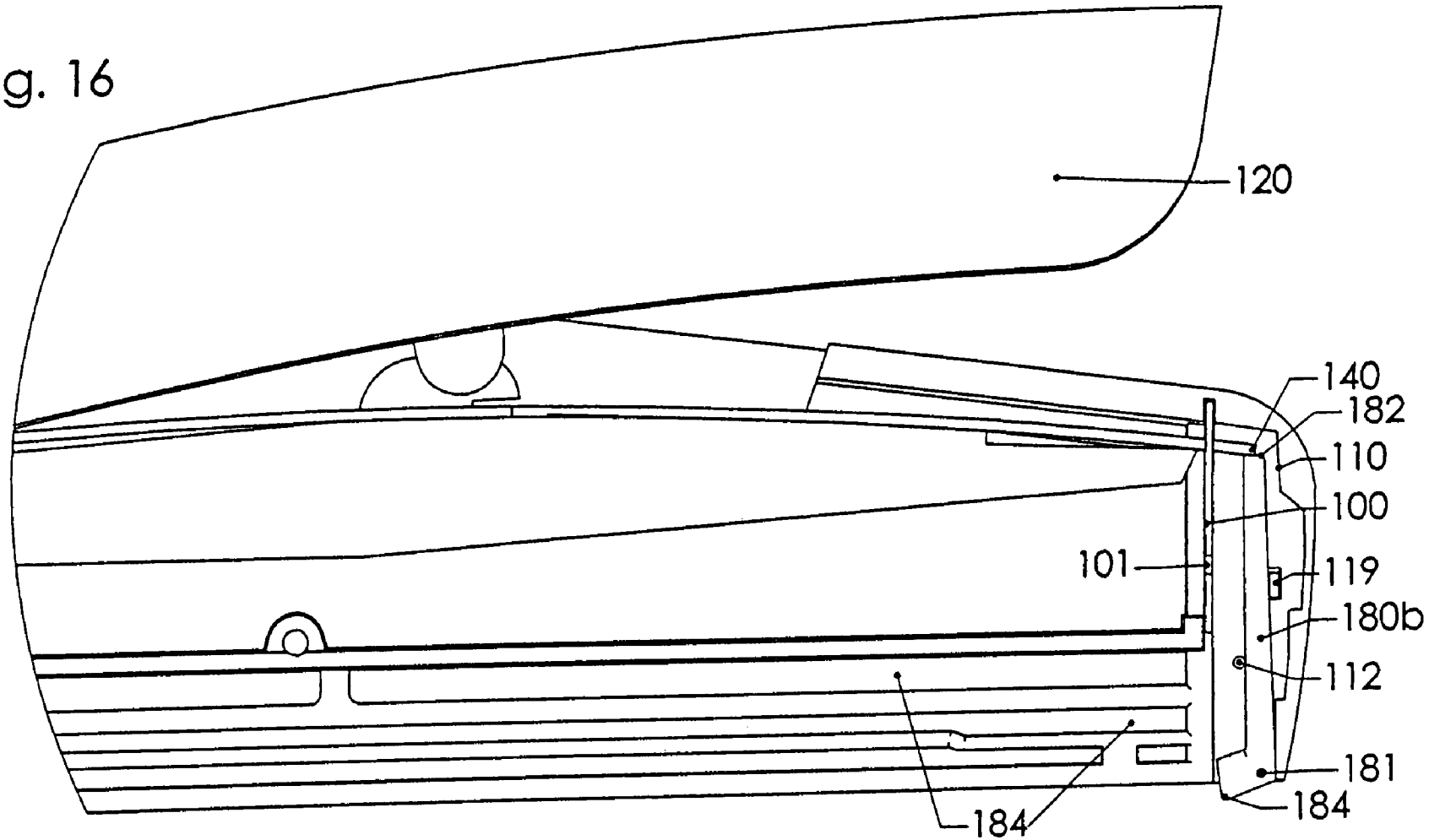
FIG. 16 is a simplified schematic view of a still yet another embodiment safety mechanism wherein the striker locking mechanism is engaged and intervenes in the striker's downward movement.
Figure 17:
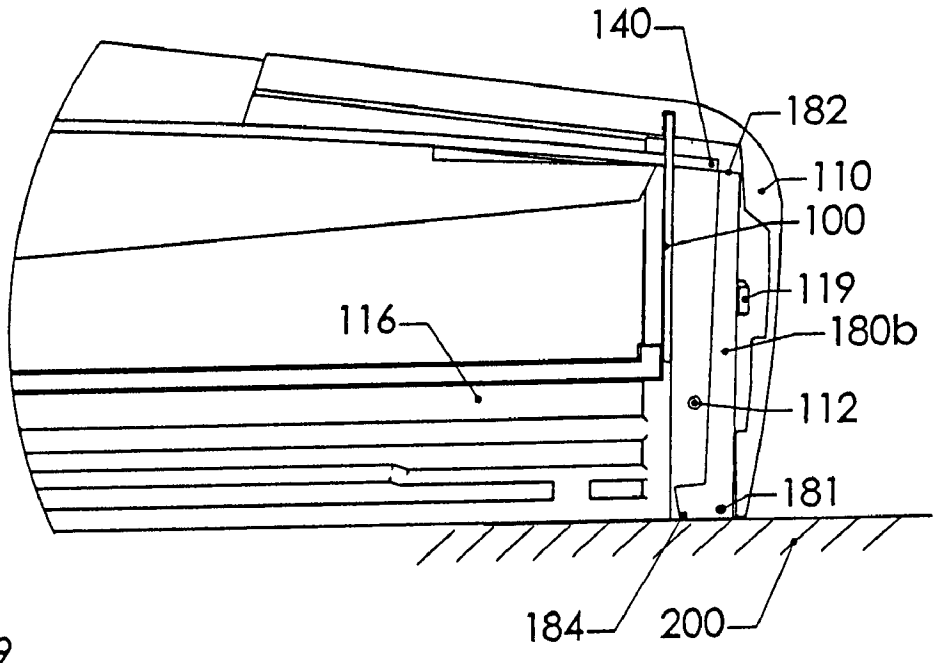
FIG. 17 is a simplified schematic view of the stapler of FIG. 16 with the striker locking mechanism shown disengaged while the stapler is pressing against a working surface.
Figure 18:
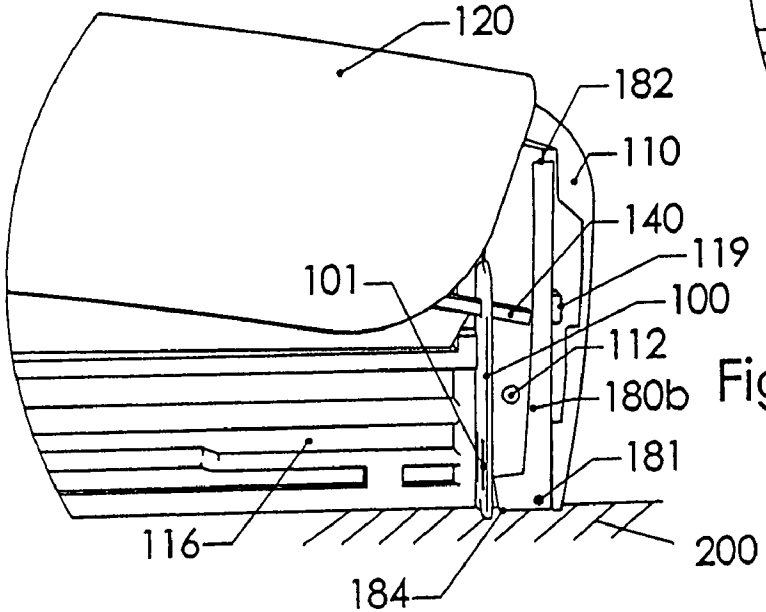
FIG. 18 is a simplified schematic view of the stapler of FIG. 17 wherein the striker locking mechanism is disengaged, the handle is in its lowered position, and a staple has been ejected.

FIGS. 16–18 show an alternative embodiment of the present invention with a pivoting lock bar 180*b* similar to the above-described embodiments. In FIGS. 16–18, a high-start embodiment is shown. Lock bar 180*b* is pivotably attached to stapler body 110 at pivot 181. In FIG. 16, the stapler is in its rest position. Actuating tip 184 of lock bar 180*b* extends out from the stapler body. A stapler-actuating arm 140 holds striker 100 in the rest position above staple track 116. A reset spring (not shown) biases the mechanism upward toward the rest position of FIG. 16. FIG. 18 is a view of striker 100 in a lower position.

In this alternative embodiment, the stapler-actuating arm is a power spring and is used as in a high-start type spring actuated stapler. In FIG. 16, stapler-actuating arm/power spring 140 stores energy as handle 120 is pressed downward toward body 110. The stored energy when transferred to striker 100 accelerates the striker within striker slot 101 to cause sudden ejection of a staple (not shown) by impact blow by striker 100 when the power spring is released at a predetermined position of handle 120.

A release mechanism (not shown) holds striker 100 in the upper rest position until handle 120 is pressed to a predetermined position toward body 110. Such a release mechanism for a high-start stapler is known in the art. For example, U.S. Pat. No. 5,356,063 (Perez), whose entire contents are hereby incorporated by reference, shows a high-start design. In Perez '063, lever 53 with tips 48 engages striker 24. At a predetermined position of handle 30, lever 53 is forced to rotate out of engagement from striker 24 and power spring 40 forces the striker downward. However, the stapler of Perez '063 discloses no safety mechanism.

Figure 20:
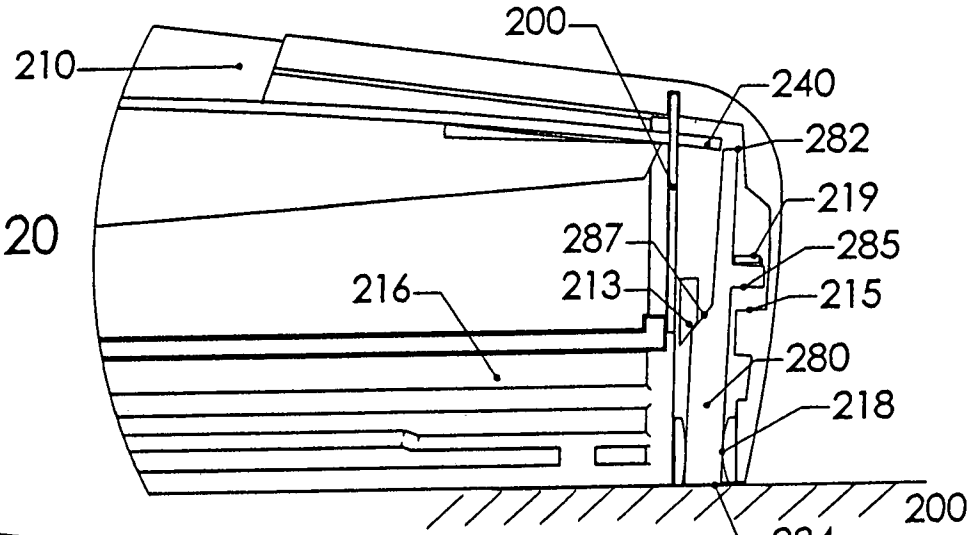
FIG. 20 is a simplified schematic view of the stapler of FIG. 19 wherein the cam action lock bar is engaged to intervene in the striker motion.
Figure 19:
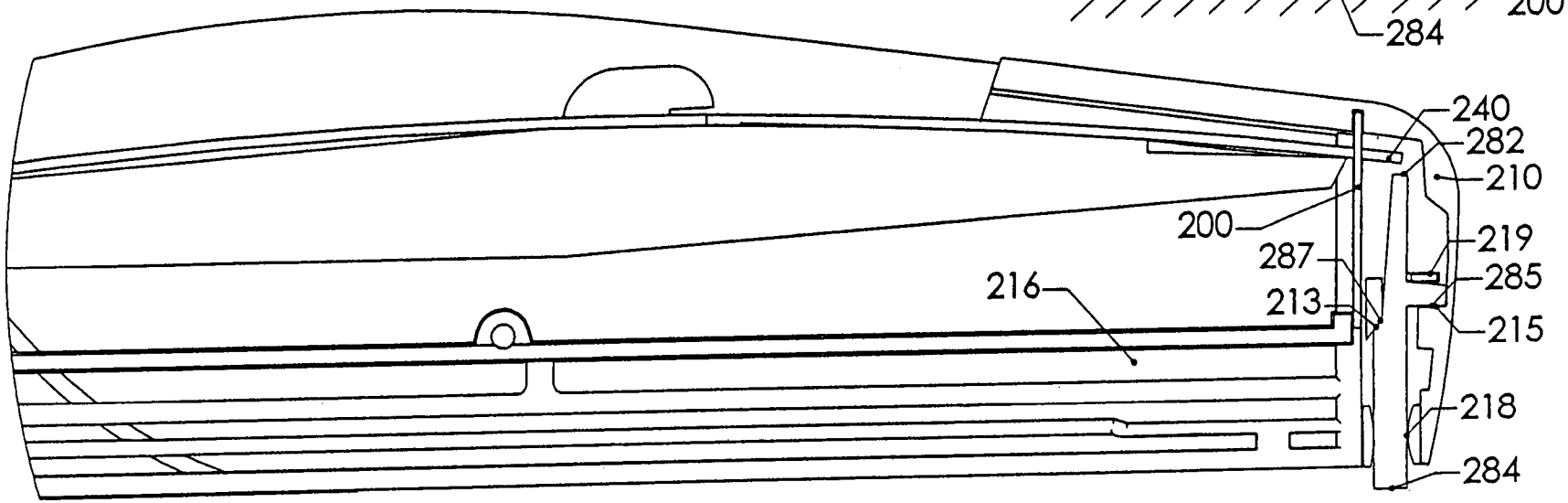
FIG. 19 is a simplified schematic view of a stapler having an alternative embodiment striker locking mechanism that uses a cam action lock bar shown disengaged while the stapler is pressing against a working surface.

As applied to the embodiments in FIGS. 16–20, for example, an equivalent lever to lever 53 of Perez '063 may be fitted behind striker 100 of FIGS. 16–18 or striker 200 of FIGS. 19–20. The lever would be linked to handle 120 or 210 of FIGS. 16–20 so that the lever releases the striker at a predetermined position of the handle.

The staple is thereby propelled out from track 116 and driven into a stack of papers, for instance. In the case that actuating arm 140 is a power spring, handle 120 is resiliently linked to striker 100. That is, one or more components linking handle 120 to stapler-actuating arm 140 may have compliance or springiness to it. Handle 120 then may move toward body 110 even as the locking device prevents striker 100 from moving downward as shown in FIG. 16.

Alternatively, actuating arm 140 may be a rigid member that is substantially, rigidly linked to handle 120. Such a mechanism is incorporated into a non-spring actuated stapler with the benefit of the safety device of the present invention. With such an arrangement, the locking mechanism or lock bar 180*b* prevents motion of both striker 100 and the rigidly linked handle 120. A reset spring (not shown) urges actuating arm 140 upward to hold striker 100 in the upper rest position shown in FIG. 16.

In FIG. 16, engaging end 182 of lock bar 180*b* is positioned under stapler-actuating arm/power spring 140. Therefore, stapler-actuating arm/power spring 140 cannot move downward. In a slight modification, an engaging end of lock bar 180*b* could directly link to striker 100, for example, at one or more slots 111 formed in striker 100 shown in FIG. 10. Lock bar 180*b* is normally biased against stop 112 by elongated spring 119.

In FIG. 17, the stapler is shown pressed against working surface 200. In the case of a desktop stapler, working surface 200 may be a stack of papers to be fastened. Actuating tip 184 encounters working surface 200 and is pressed upward into body 110. Lock bar 180*b* rotates clockwise about pivot 181 and simultaneously moves forward against the bias of elongated spring 119. Elongated spring 119 may be an extended element of body 110, if for example body 110 is constructed of a plastic material with some compliance. Otherwise, elongated spring 119 may be a discrete component attached to the body.

Engaging end 182 has pivoted forward and clear of stapler-actuating arm/power spring 140 in FIG. 17. As a result, the assembly of striker 100 and actuating arm 140 are now free to accelerate downward and eject a staple with great inertia.

FIG. 18 shows the stapler configuration of FIGS. 16–17 after ejection of a staple. Both handle 120 and striker 100 are in their respective lowest positions.

FIGS. 19 and 20 show in simplified schematic views a further alternative embodiment of the present invention. Lock bar 280 is slidably and pivotably fitted to body 210 and undergoes a cam action. Actuating tip 284 of lock bar 280 extends downward and out from the body 210 in the rest position of FIG. 19. In its cam action, lock bar 280 slides, jogs, and/or pivots along a path defined by guides 218 formed inside body 210. More precisely, guides 218 may be simply bumpers formed inside the housing from the same material as the housing; they may be metal ribs; they may be low friction Teflon or like inserts; or they may be contours inside the body covered with a low friction coating. The path of travel for lock bar 280 is generally straight and vertical with a segment that is a sloped jog laterally, as is apparent by comparing FIGS. 19 and 20. To enhance low friction movement of lock bar 280 along its path of travel, the lock bar may be covered with a low viscosity coating or gel, or it could be made from a low friction material such as a fluoropolymer like Teflon or acetal, which has a slick surface but has sufficient structural rigidity and strength to fulfill the safety function. Fiberglass or fiber reinforced plastic may also be used to form all or part of lock bar 280. The low friction materials and coatings may be applied to the path of travel as well.

Body cam 213 of body 210 is adjacent to lock bar cam 287 of lock bar 280. Actuating tip 284 is positioned below stapler-actuating arm 240, which again in a spring energized high-start stapler would preferably be a beam type power spring.

A vertical space may preferably be provided between actuating arm/power spring 240 and engaging end 282 as shown. Arm 240 with striker 200 is free to move very slightly downward, but they still cannot move down far enough to eject a staple. The space allows lock bar 280 to both slide upward and rotate at guides 218 as respective cams 213 and 287 engage in response to contacting working surface 200 in FIG. 20. As a result, engaging end 282 is shifted forward and clear of arm 240 in FIG. 20. Arm 240 and striker 200 are then free to accelerate to a lower most position to eject a staple from staple track 216 below. Extended spring 219 biases lock bar 280 downward to a lower limit at edge 285 against stop 215. Spring 219 further biases engaging end 282 to be under arm 240.

In all of the above described embodiments, the safety mechanism includes a position to inhibit movement of the striker, and components linked to the striker from completing an operational cycle to eject a staple. In the preferably low-start designs of FIGS. 1–15, a hook, arm or similar structure selectively intercepts the striker or the handle to prevent cycling motion toward the release point. In the high-start versions of FIGS. 16–20, an arm or equivalent structure selectively prevents the striker from moving in the downward cycle from the release point. Optionally, in the high-start versions, the arm structure may selectively prevent the handle from moving through the cycle to a release position of the handle.

Although described above in connection with a spring energized stapler, the safety mechanism of the present invention is useful in a variety of devices. For example, it may be fitted to a staple gun, power driven stapler, nailer, or the like. By employing the safety mechanism of the present invention, a compact device can prevent unintended ejection of fasteners without complex linkages to internal components of that stapler, staple gun, or the like.

From the foregoing detailed description, it should be evident that there are a number of changes, adaptations and modifications of the present invention that come within the province of those skilled in the art. However, it is intended that all such variations not departing from the spirit of the invention be considered as within the scope thereof except as limited solely by the following claims.

What is claimed is:

1. A safety mechanism for a self-powered tool that ejects and drives fasteners into a working surface, comprising:

a housing having a striker at a front of the housing slidable along a path therein between an upper position and a lower position;

a fastener disposed within the housing along the path of the striker, wherein the fastener is ejected from the tool as the striker moves from the upper position to the lower position;

a power spring biasing the striker into the fastener;

a pivoting release lever selectively linked to the striker;

a hooking bar pivotably engaging the housing and biased into hooking the striker at an opening in the striker to substantially immobilize the striker before the striker impacts the fastener;

a sensor bar having a first end and a second end, wherein the first end of the sensor bar extends from the housing, and wherein the sensor bar translates linearly in the housing, and the second end of the sensor bar selectively engages the hook to generate a pivoting motion; and wherein the second end of the sensor bar engages the working surface which translates the second end of the sensor bar into the hooking bar to pivot the hooking bar against the bias and out of the path of the striker thus enabling the striker to slide along the path in the housing.

2. The safety mechanism of claim 1, wherein the hooking bar includes an L shape with a pivot end engaging an anchoring notch formed in the housing and a hooked opposing end.

3. The safety mechanism of claim 2, wherein the sensor bar includes a flared notch for receiving a portion of the hooking bar therein, wherein linear translation of the sensor bar translates the flared notch which flaps the portion of the hooking bar therein.

4. The safety mechanism of claim 1, wherein the opening in the striker includes an elongated slot to receive a hook end of the hooking bar.

5. The safety mechanism of claim 1, wherein the sensor bar includes a curled resilient cantilever arm to engage the housing creating a biasing force.

6. The safety mechanism of claim 1, wherein the hooking bar is positioned in the housing in front of the striker.

7. The safety mechanism of claim 1, wherein the hooking bar holds the striker in the upper position.

8. A stapler comprising:

a housing;

a track attached to the housing to guide staples upon the track toward a linearly translating striker at a front of the stapler, the linearly translating striker including a raised position above the staples and a lowered position wherein the striker impacts a front-most staple outward from the stapler as the striker moves from the raised position to the lowered position;

a hook pivotably mounted to the housing and biased into engaging the striker at an opening therein to substantially immobilize the striker; and a button bar having a sensing end extending from a bottom of the housing in a lowered position, wherein the button bar is linked to move the hook, and pressing the sensing end of the button bar upward into the stapler moves the hook to disengage from the opening releasing the striker to freely move to the lowered position.

9. The stapler of claim 8, wherein the button bar includes a U-shaped cantilevered arm, and the hook includes an L-shape and pivots about one end of the L against the housing.

10. The stapler of claim 9, wherein the housing includes an anchoring notch receiving the pivoting end of the hook and the U-shaped cantilevered arm includes a flared opening enabling a portion of the hook to flap therein.

11. The stapler of claim 10, wherein the button bar includes a curled cantilevered arm having resilience, wherein the curl engages the housing and biases the button bar to extend from the bottom of the housing.

12. The stapler of claim 8, wherein the hook is positioned in the housing in front of the striker.

13. A safety mechanism for a self-powered tool that ejects and drives fasteners into a working surface, comprising:

a housing having a striker slidable along a path therein;

a fastener disposed within the housing along the path of the striker; a power spring biasing the striker into the fastener;

a pivoting release lever selectively linked to the striker such that the striker is released when the lever is de-linked therefrom;

a lock bar having a locking end and a projecting end pivotably disposed to the housing wherein the projecting end of the lock bar extends from a bottom of the housing;

a biasing means urging the locking end of the lock bar into substantially immobilizing at least one of the power spring and the release lever which in turn substantially immobilizes the striker in at least one direction of travel; and wherein the projecting end of the lock bar is pushed into the housing by the working surface which pivots the locking end out of engagement with at least one of the power spring and the release lever, thereby releasing the striker so that the striker completes an operational cycle and is biased into the fasteners.

14. The safety mechanism of claim 13, wherein the lock bar includes an elongated shape with bends at the locking end and the projecting end both facing the rearward direction, and a hinge is forward of the projecting end.

15. The safety mechanism of claim 13, wherein the lock bar pivot is disposed on the housing proximate to a bottom edge thereof.

16. A safety mechanism for a self-powered tool that ejects and drives fasteners into a working surface, comprising:

a housing having a striker slidable along a path therein;

a fastener disposed within the housing along the path of the striker;

a power spring biasing the striker into the fastener;

a pivoting release lever selectively linked to the striker such that the striker is released when the lever is de-linked therefrom;

a lock bar having a blocking end and a projecting end movably disposed to the housing;

a biasing means urging the blocking end of the lock bar into engaging the power spring opposing the bias on the striker, and wherein the projecting end of the lock bar extends from a bottom of the housing; and wherein the projecting end of the lock bar is pushed into the housing by the working surface which moves the blocking end out of engagement with the power spring, enabling the power spring to bias the striker into the fastener.

17. The stapler of claim 16, wherein the blocking end of the lock bar pivots into a position underneath the power spring to obstruct the biasing force thereof.

18. A safety mechanism for a self-powered tool that ejects and drives fasteners into a working surface, comprising:

a housing having a striker slidable along a path therein;

a fastener disposed within the housing along the path of the striker;

a power spring biasing the striker into the fastener;

a handle pivoted against the housing;

a release lever pressed at one end into a pivoting action by the handle and selectively linked to the striker at another end such that the striker is released when the lever is de-linked therefrom;

a lock bar having a blocking end and a projecting end pivotably disposed to the housing;

a biasing means urging the blocking end of the lock bar into engaging and limiting motion of the handle at least in one direction, and wherein the projecting end of the lock bar extends from a bottom of the housing; and wherein the projecting end of the lock bar is pushed into the housing by the working surface and pivots the blocking end out of engagement with the handle, enabling the handle to continue pivoting the release lever into de-linking from the striker, which striker is then biased into the fasteners.

19. The safety mechanism of claim 18, wherein the handle includes an extension and the projecting end of the lock bar engages the extension from underneath.

20. A safety mechanism for a self-powered tool that ejects and drives fasteners into a working surface, comprising:

a housing having a back end and a striker slidable along a path therein located at a forward end thereof a fastener disposed within the housing along the path of the striker;

a power spring biasing the striker into the fastener;

a pivoting release lever selectively linked to the striker such that the striker is released when the lever is de-linked therefrom;

a lock bar having a blocking end and a projecting end with a sloped cam surface therebetween;

a sloped cam guide disposed on the housing and slidably engaging the sloped cam surface of the lock bar;

a biasing means urging the projecting end of the lock bar to extend from a bottom of the housing and into obstructing the bias of the power spring; and wherein the projecting end of the lock bar is pushed into the housing by the working surface against the biasing means, and which slides the cam surface of the lock bar against the cam guide to move the blocking end away from the power spring, enabling the power spring to bias the striker into the fasteners.

21. The safety mechanism of claim 20, wherein the cam surface of the lock bar and the cam guide have complementary sloped surfaces so that movement of the lock bar includes simultaneously motion in the X and Y directions.

22. The safety mechanism of claim 20, wherein the lock bar pivots about the sloped cam guide of the housing.

23. The safety mechanism of claim 20, wherein the blocking end engages a surface of a front end of the power spring.

24. The safety mechanism of claim 20, wherein the blocking end engages the striker.

* * * * *